US010088808B2

(12) United States Patent
Miyahara

(10) Patent No.: US 10,088,808 B2
(45) Date of Patent: Oct. 2, 2018

(54) ELECTRONIC TIMEPIECE

(71) Applicant: SEIKO EPSON CORPORATION, Tokyo (JP)

(72) Inventor: Fumiaki Miyahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 15/086,394

(22) Filed: Mar. 31, 2016

(65) Prior Publication Data

US 2016/0313699 A1 Oct. 27, 2016

(30) Foreign Application Priority Data

Apr. 24, 2015 (JP) ..... 2015-089385

(51) Int. Cl.
*G04C 17/00* (2006.01)
*G04D 99/00* (2006.01)

(52) U.S. Cl.
CPC ..... *G04C 17/0066* (2013.01); *G04D 99/00* (2013.01)

(58) Field of Classification Search
CPC ..... G04C 3/14
See application file for complete search history.

(56) References Cited

U.S. PATENT DOCUMENTS 5,280,459 A * 1/1994 Nakamura ..... G04C 3/14 368/187
5,305,289 A * 4/1994 Besson ..... G04C 17/0066 368/28
6,072,752 A * 6/2000 Igarashi ..... G04C 3/14 368/187
6,830,371 B2 * 12/2004 Masaki ..... G04G 3/00 368/187
6,934,223 B2 * 8/2005 Martin ..... G04G 19/08 368/203
2002/0167869 A1 * 11/2002 Masuda ..... G04C 3/14 368/238
2004/0022135 A1 * 2/2004 Yiu ..... G04C 3/14 368/187
2004/0120220 A1 * 6/2004 Ogasawara ..... G04C 3/14 368/80
2004/0120221 A1 * 6/2004 Ogasawara ..... G04C 3/14 368/80
2004/0125702 A1 * 7/2004 Kitajima ..... G04C 3/14 368/80
2008/0068930 A1 3/2008 Richter et al.
(Continued)

FOREIGN PATENT DOCUMENTS

JP 10-300869 A 11/1998
JP 05-256958 A 10/2005
JP 2008-502884 A 1/2008

*Primary Examiner* — Edwin A. Leon
*Assistant Examiner* — Jason Collins

(57) ABSTRACT

An electronic timepiece includes a date indicator that is an analog display member, a date indicator motor that drives the date indicator, a display position storage that is a nonvolatile memory that stores position information on the date indicator, a receiver that is a time information acquirer that externally acquires time information, and a control section that outputs a drive signal to the date indicator motor and stores the position information on the date indicator in the display position storage whenever the date indicator motor activated with the drive signal drives the date indicator.

4 Claims, 4 Drawing Sheets

(56) References Cited

U.S. PATENT DOCUMENTS

| | | | | |
|---|---|---|---|---|
| 2009/0086580 | A1* | 4/2009 | Aoki | G04C 3/14 368/10 |
| 2009/0086581 | A1* | 4/2009 | Suizu | G04C 3/14 368/10 |
| 2009/0161120 | A1* | 6/2009 | Kojima | G04C 3/14 356/615 |
| 2009/0296533 | A1* | 12/2009 | Kojima | G04C 3/14 368/185 |
| 2009/0296534 | A1* | 12/2009 | Kojima | G04C 3/14 368/185 |
| 2010/0061193 | A1* | 3/2010 | Kasuo | G04C 10/02 368/204 |
| 2014/0092714 | A1* | 4/2014 | Nagareda | G04C 3/14 368/187 |
| 2014/0286138 | A1* | 9/2014 | Hasegawa | G04C 3/14 368/80 |
| 2015/0268638 | A1* | 9/2015 | Hasegawa | G04R 20/04 368/47 |
| 2015/0362893 | A1* | 12/2015 | Masserot | G04G 5/00 368/4 |

* cited by examiner

ELECTRONIC TIMEPIECE

BACKGROUND

1. Technical Field

The present invention relates to an electronic timepiece including an analog display member, such as a date indicator and a day indicator.

2. Related Art

Among radio timepieces, there is a known electronic timepiece that operates as follows: When the timepiece determines that the battery needs to be exchanged, date display is moved to a predetermined reference position; after the battery is exchanged, the timepiece receives a time notification signal, such as a standard radio wave, and checks the current data; and the date display (such as date indicator) is moved from the reference position to a current date display position.

In JP-T-2008-502884, however, even when the voltage of the battery decreases and the battery therefore needs to be exchanged, the date display needs to be moved to the reference position. To this end, a battery exchange process needs to be initiated in a state in which the battery still has a relatively large amount of capacity, and the duration of the electronic timepiece is undesirably shortened accordingly.

Further, since the date display has been moved to the predetermined reference position, for example, the "1-st" of the month, after the battery exchange, the average period from the reception of the time notification signal to the correction of the date display is undesirably prolonged.

The problems described above are not problems only with date display, such as a date indicator, but are common to electronic timepieces in which an analog display member, such as an indicating hand and a calendar wheel, is moved to a reference position when system reset occurs due, for example, to battery exchange for adjustment of the display position of the analog display member to information on the display position.

SUMMARY

An advantage of some aspects of the invention is to provide an electronic timepiece capable of prolonging the duration thereof and shortening the average period spent to correct the display position of an analog display member.

An electronic timepiece according to an aspect of the invention includes an analog display member, a driver that drives the analog display member, a nonvolatile memory that stores position information on the analog display member, a time information acquirer that externally acquires time information, and a control section that outputs a drive signal to the driver and stores the position information on the analog display member in the nonvolatile memory whenever the driver activated with the drive signal drives the analog display member.

In the aspect of the invention, the control section stores the current position information in the nonvolatile memory whenever the analog display member is driven. Therefore, when the battery voltage decreases and system reset occurs, it is unnecessary to return the analog display member to a reference position. The duration of the electronic timepiece can therefore be prolonged as compared with a case where the analog display member is moved to the reference position.

In a case where the battery voltage is increased after the system reset, and the time information acquirer acquires time information, since the current display position of the analog display member is stored in the nonvolatile memory, the control section does not need to move the analog display member to the reference position but can directly move the analog display member from the current display position to a position indicating the acquired time information.

Therefore, the duration of the electronic timepiece can be prolonged, and the average period spent to correct the display position of the analog display member can be shortened.

In the electronic timepiece according to the aspect of the invention, the analog display member, the position information of which is stored in the nonvolatile memory, is preferably an analog display member that displays information other than a second, a minute, or an hour.

In the aspect of the invention, since information other than a second, a minute, or an hour, for example, the display position of the analog display member, such as a date indicator, which displays a date, and a day indicator, which display a day, is stored in the nonvolatile memory, the frequency of the operation of writing the display position in the nonvolatile memory can be, for example, as few as once per day. The amount of electric power consumed by the writing operation performed on the nonvolatile memory can be lowered, and the duration of the electronic timepiece can be prolonged also in this regard.

In the electronic timepiece according to the aspect of the invention, it is preferable that the driver is a stepping motor including a rotor having magnetized two poles, and that the control section stores the position information on the analog display member and polarity information on the drive signal outputted to the stepping motor in the nonvolatile memory.

In the aspect of the invention with this configuration, since the polarity information on the drive signal is stored in the nonvolatile memory, the drive signal outputted to the driver, which drives the analog display member, after system reset, can be a correct drive signal the polarity of which differs from the polarity information on the last inputted drive signal, whereby the driver can be reliably driven with a first drive signal.

It is preferable that the electronic timepiece according to the aspect of the invention further includes an external operation member that activates the driver via the control section to drive the analog display member for reference position adjustment, and the control section overwrites reference position information stored in the nonvolatile memory when the reference position adjustment of the analog display member is performed through the external operation member.

When the reference position adjustment, in which the analog display member, such as a date indicator, is moved to a preset reference position, is performed through the external operation member, such as a crown and a button of the electronic timepiece, the control section overwrites the reference position information stored in the nonvolatile memory. A user can therefore set a position specified by operating the external operation member as the reference position, whereby a shift of a position indicated by the analog display member can be eliminated.

It is preferable that the electronic timepiece according to the aspect of the invention further includes an external operation member that activates the driver via the control section to drive the analog display member for position adjustment and a position detector that detects that the analog display member has moved to a preset reference position, and the control section causes the nonvolatile memory to store information on a difference between position information obtained when the position adjustment is performed through the external operation member and position information obtained when the position detector detects the reference position.

According to the electronic timepiece of the aspect of the invention with this configuration, when the reference position detected by the position detector deviates from a proper reference position, the external operation member can be operated to adjust the position of the analog display member to the proper reference position, and information on the difference between the reference position of the analog display member detected by the position detector and the position information obtained when the position adjustment is performed through the external operation member can be stored in the nonvolatile memory. Therefore, when the analog display member is driven after system reset, using the difference information allows the analog display member to be driven in accordance with the reference position having been set by the user.

BRIEF DESCRIPTION OF THE DRAWINGS

The invention will be described with reference to the accompanying drawings, wherein like numbers reference like elements.

DESCRIPTION OF EXEMPLARY EMBODIMENTS

A first embodiment of the invention will be described below with reference to the drawings.

An electronic timepiece according to the first embodiment is a radio correction timepiece 1, which receives a standard radio wave to acquire time information.

Figure 1:
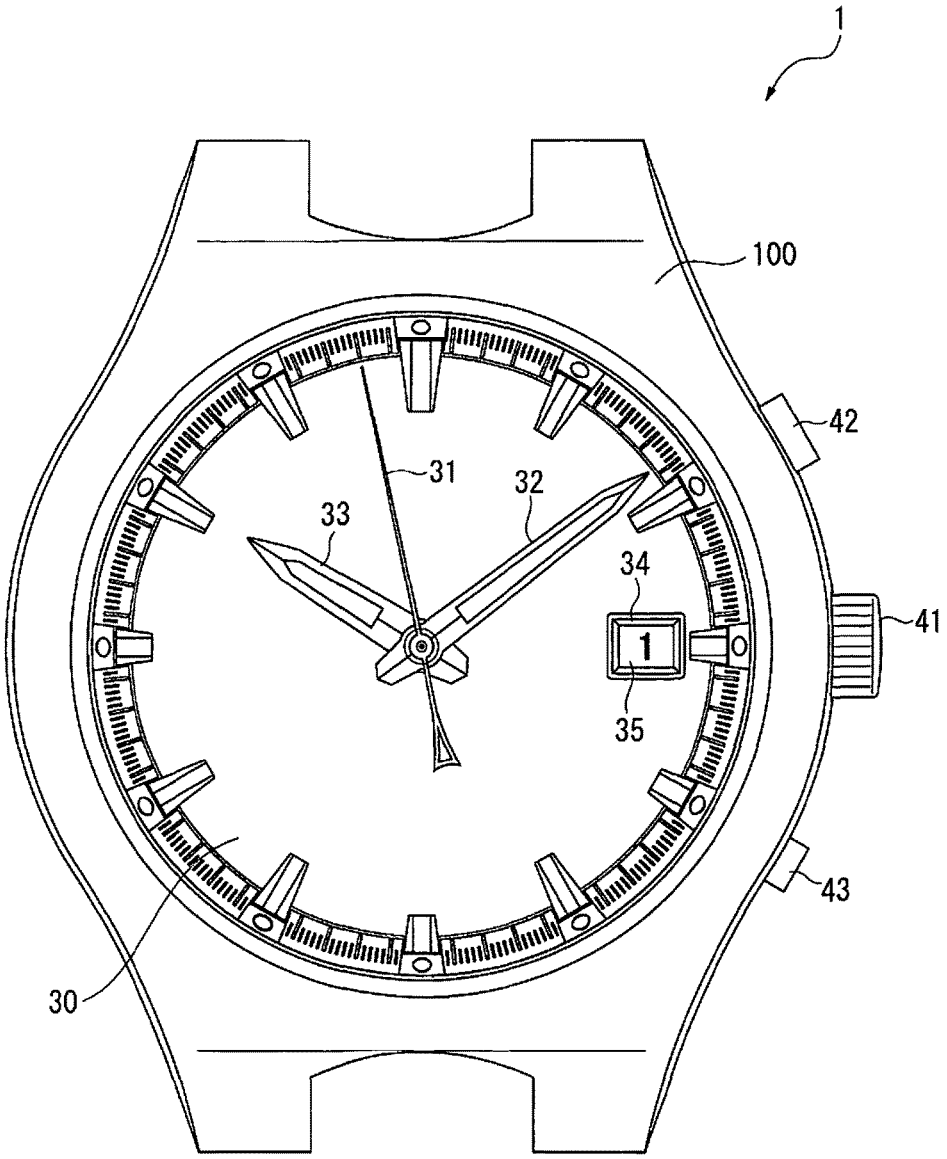
FIG. 1 is a front view showing an electronic timepiece according to a first embodiment.
Figure 2:
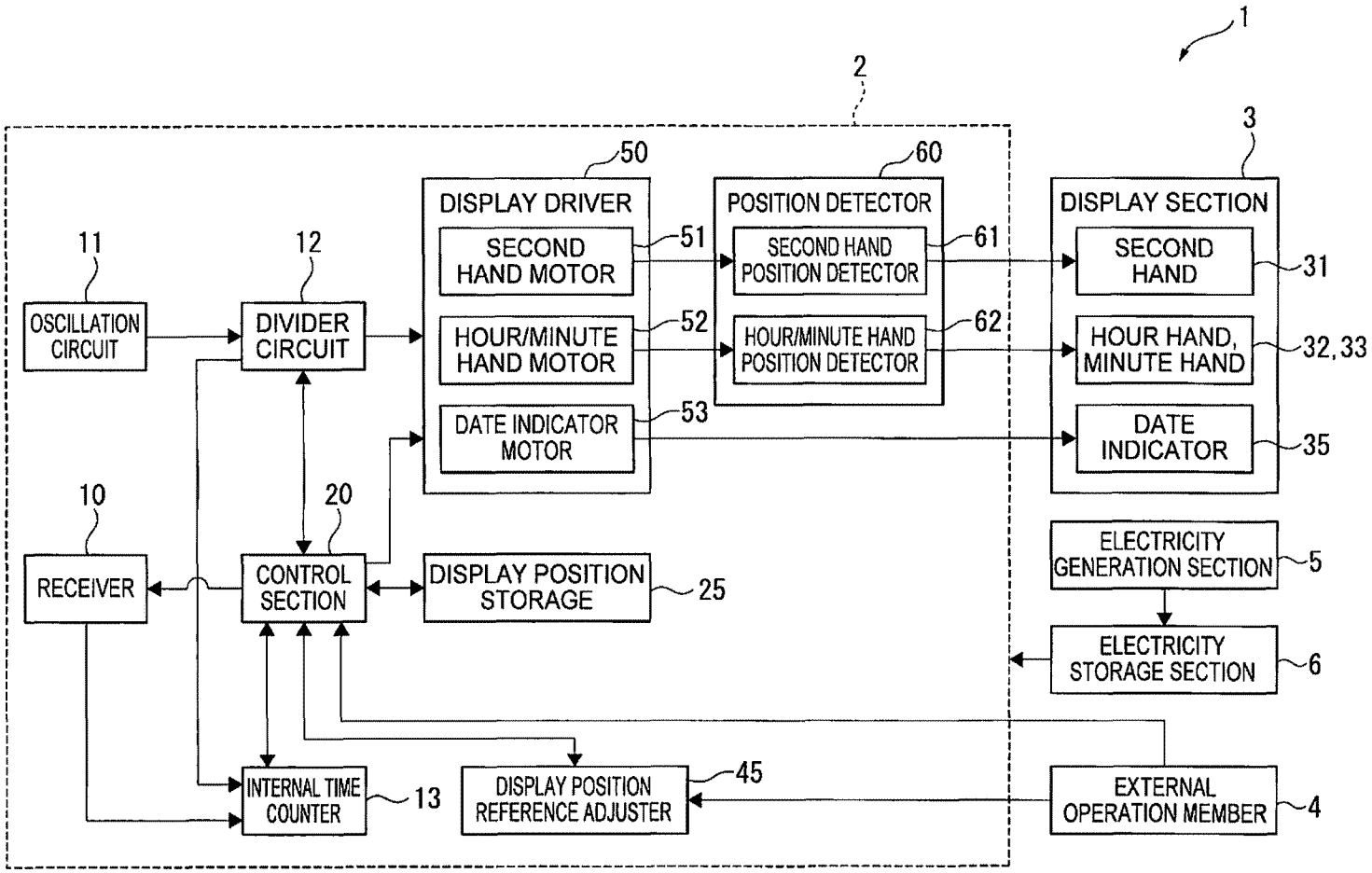
FIG. 2 is a block diagram showing the internal configuration of the electronic timepiece according to the first embodiment.

FIG. 1 is a front view showing the radio correction timepiece 1 according to the first embodiment, and FIG. 2 is a block diagram showing the internal configuration of the radio correction timepiece 1.

The radio correction timepiece 1 includes an exterior case 100, a movement 2 incorporated in the exterior case 100, a display section 3, which is driven by the movement 2 to display time, an external operation member 4 to be operated externally, an electricity generation section 5, which is formed, for example, of a solar cell or a generator using a rotating weight, and an electricity storage section 6, such as a secondary battery that stores electric power generated by the electricity generation section 5.

The display section 3 of the radio correction timepiece 1 includes a dial 30, a second hand 31, a minute hand 32, an hour hand 33, and a date indicator 35. On the dial 30 are formed markings (indices) indicated with the indicating hands 31 to 33 for time display and a date window 34.

The display section 3 may further include a day indicator. The display section 3 may instead display information other than time information. For example, the display section 3 may include an indicating hand that displays the charged level of the electricity storage section 6 and a mode hand that displays the action mode (such as reception mode) of the radio correction timepiece 1.

The radio correction timepiece 1 includes a crown 41, an A button 42, and a B button 43 as the external operation member 4. When the crown 41 is pulled out one step, the action mode transitions to a manual date adjustment mode, and when the crown 41 is pulled out two steps, the action mode transitions to a manual time adjustment mode. In the modes described above, manually operating the A button 42 allows movement of the date indictor 35, the minute hand 32, and the hour hand 33, as will be described later.

Movement 2

The movement 2 of the radio correction timepiece 1 includes a receiver (reception circuit) 10, which is a time information acquirer, an oscillation circuit 11 and a divider circuit 12, an internal time counter 13, a control section 20, a display position storage 25, which is formed of a nonvolatile memory, a display position reference adjuster 45, a display driver 50, and a position detector 60.

The receiver 10 has the same configuration of a typical standard radio wave reception circuit and includes an antenna that is not shown and a tuning circuit that is not shown but is formed, for example, of a tuning capacitor. The receiver 10 is configured to be controlled by the control section 20 and receive, with antenna, a long-wavelength standard radio wave having a frequency set by the tuning circuit. The long-wavelength standard radio to be received is so set that the type thereof is chosen from JJY, WWVB, DCF77, BPC, and other standards.

The receiver 10 further includes an amplification circuit, a bandpass filter, a demodulation circuit, a decode circuit, and other components, neither of which is shown, and extracts a time code, which is digital data, from the received long-wavelength standard radio. The receiver 10 therefore forms a time information acquirer. The time code extracted by the receiver 10 is outputted to the internal time counter 13.

The control section 20 activates the receiver 10 in two reception processes, an automatic reception process and a forced reception process. In the automatic reception process, the control section 20 activates the receiver 10 when internal time counted by the internal time counter 13 reaches fixed time set in advance. In the forced reception process, the control section 20 activates the receiver 10 when the external operation member 4, specifically the A button 42 is pressed for a long period.

The oscillation circuit 11 includes a reference signal source that is not shown, for example, a quartz oscillator, causes the reference signal source to oscillate at a high frequency, and outputs an oscillation signal produced by the high-frequency oscillation to the divider circuit 12.

The divider circuit 12 divides the oscillation signal outputted from the oscillation circuit 11 and outputs a predetermined reference signal, for example, a 1-Hz pulse signal to the internal time counter 13. The divider circuit further outputs the pulse signal of a predetermined frequency to the control section 20 and the display driver 50.

The internal time counter 13 is formed of counters that count time information, such as "second, minute, hour, date, day, month, and year," and counts the internal time by using the reference signal from the divider circuit 12.

Display Driver

The display driver 50 includes a second hand motor 51, an hour/minute hand motor 52, and a date indictor motor 53. Each of the motors 51, 52, and 53 is a stepping motor including a rotor having magnetized two poles and is driven with drive pulses (drive signal) outputted from the control section 20.

The second hand motor 51 drives the second hand 31 via a wheel train that is not shown. The hour/minute hand motor 52 drives the minute hand 32 and the hour hand 33 via a wheel train that is not shown. The date indicator motor 53 drives the date indicator 35 via a wheel train that is not shown.

Position Detector

The radio correction timepiece 1 includes the position detector 60, which detects reference positions (0 positions) of the second hand 31, the minute hand 32, and the hour hand 33. The position detector 60 includes a second hand position detector 61, which detects that the second hand 31 driven with the second hand motor 51 has moved to the reference position (0-second position), and an hour/minute hand position detector 62, which detects that the minute hand 32 and the hour hand 33 driven with the minute/hour hand motor 52 has moved to the reference position (12-hour-0-minute position).

The second hand position detector 61 and the hour/minute hand position detector 62 can be a hand position detection device having been used in related art, for example, a hand position detection device so configured that through holes are formed through gears that form the wheel trains that drive the second hand 31, the minute hand 32, and the hour hand 33 and light from a light emitting device is allowed to pass through the through holes to a light receiving device when the second hand 31, the minute hand 32, and the hour hand 33 indicate the reference positions.

Display Position Storage

The display position storage 25 is formed of a nonvolatile memory, such as an EEPROM (electrically erasable and programmable read only memory). The display position storage 25 stores the display position of the date indicator 35, as will be described later. In the present embodiment, the date indicator 35 therefore forms the analog display member, position information of which is stored in the nonvolatile memory.

Since the reference positions of the secondhand 31, the minute hand 32, and the hour hand 33 can be detected by the hand position detectors during movement of the hands, the display position storage 25 does not store the display positions of the indicating hands 31 to 33 in the present embodiment.

Display Position Reference Adjuster

The display position reference adjuster 45 carries out display position reference adjustment via the control section 20 when the external operation member 4 is operated for the display position reference adjustment.

Specifically, when a user presses the A button 42 and the B button 43 at the same time for a long period (for at least 4 seconds, for example), the display position reference adjuster 45 is activated and the action mode of the timepiece transitions to a date display position reference adjustment mode. In this process, the control section 20 activates the second hand motor 51 to move the second hand 31 to a predetermined position, for example, a 13-second position so as to notify the user that the action mode has transitioned to the date display position reference adjustment mode.

In the date display position reference adjustment mode, when the user presses the B button 43, the control section 20 outputs drive pulses to the date indicator motor 53, and the date indicator 35 rotates accordingly. Since the date indicator 35 is a ring-shaped large display member, the control section 20 needs to output a plurality of pulses (150 pulses, for example) to cause the date indicator 35 to move by an amount corresponding to one day. To this end, when the user presses the B button 43 for, for example, at least 2 seconds, the control section 20 continuously outputs the drive pulses to the date indicator motor 53 to continuously drive the date indicator 35. Thereafter, when the user presses the B Button 43 again, the date indicator motor 53 and the date indicator 35 stop.

On the other hand, when the user presses the B button 43 for a short period (shorter than 2 seconds, for example), the control section 20 sequentially outputs one drive pulse to the date indicator motor 53. The date indicator 35 therefore moves by about 0.08°. Fine adjustment of the position of the date indicator 35 can thus be made, whereby fine adjustment of the display position of the date through the date window 34 can be made. The display position of the date can therefore be manually so adjusted that the date is displayed at the center of the date window 34.

In a state in which a date reference position set in advance is achieved, for example, the numeral "1" representing the 1-st of the month has moved to the center of the date window 34, when a predetermined period (10 seconds, for example) has elapsed but the user has performed no button operation, the display position reference adjuster 45 terminates the date display position reference adjustment. In this case, the display position reference adjuster 45 stores, via the control section 20, the reference position (the 1-st of the month) of the date indicator 35 in the display position storage 25, which is formed of a nonvolatile memory. That is, the user can set the reference position of the date indicator 35, which is the analog display member, by operating the external operation member 4, and position information representing the reference position is stored in the display position storage 25.

In the date display position reference adjustment mode and in a state in which the date indicator 35 is stationary, when the user presses the A button 42 for at least 2 seconds, the action mode of the timepiece transitions to an hour/minute hand display position reference adjustment mode. In this process, the control section 20 activates the second hand motor to move the second hand 31 to the 0-second position (reference position) and stop the second hand 31 there so as to notify the user that the action mode has transitioned to the hour/minute hand display position reference adjustment mode.

Thereafter, when the user presses the B button 43, the display position reference adjuster 45 drives the hour/minute hand motor 52 via the control section 20 to move the minute hand 32 and the hour hand 33 to the 0 position (reference position). Since the radio correction timepiece 1 includes the position detector 60, the second hand 31, the minute hand 32, and the hour hand 33 move to the 0 position (reference position) and automatically stop there. In this state, when the user performs no operation for the predetermined period (10 seconds, for example), the display position reference adjuster 45 determines that the reference position adjustment has been completed. The display position storage 25 does not store the reference positions of the indicating hands 31 to 33 (0 seconds, 0 minutes, and 0 hours), as described above.

Action of Radio Correction Timepiece

A description will be made of control of action of the date indicator 35 in the radio correction timepiece 1 having the configuration described above.

After the reference position of the date indicator 35 is fixed in the date display position reference adjustment mode described above, the display position reference adjuster 45 writes and stores the "1-st" (reference position), which is the display position of the date indicator, in the display position storage 25 via the control section 20.

The receiver 10 then receives the standard radio wave to acquire the current time, and when the date is the "11-th" of the month, the control section 20 drives the date indicator motor 53 by an amount corresponding to 10 days. For example, when the number of drive pulses corresponding to one day is 150, the control section 20 outputs 150×10 drive pulses corresponding to 10 days. The date indicator then moves to a position showing the 11-th, and "11" is displayed through the date window 34. The control section 20 writes and stores the "11-th" as the current display position in the display position storage 25.

Thereafter, the control section 20 performs typical time display operation, and when the current date advances to the 12-th, the control section 20 activates the date indicator motor 53 to move the date indicator 35 to a position showing the "12-th" and stores the "12-th" as the current display position in the display position storage 25. The control section 20 further stores the polarity of the last drive pulse in the display position storage 25.

In the state in which the date indicator 35 displays the "12-th," when system reset occurs, the control section 20 activates the second hand motor 51 and the hour/minute hand motor 52 to move the indicating hands 31 to 33 until they are detected by the time indicating hand position detector so as to move them to the reference positions.

On the other hand, as for the date indicator 35, which is provided with no position detector, manual display position reference adjustment needs to be made in related art. In the present embodiment, however, since the display position storage 25 stores the "12-th," which is the current display position of the date indicator 35, the control section 20 can grasp that the date currently displayed by the date indicator 35 is the "12-th."

Since the system reset initializes the internal time counted by the internal time counter 13, the timepiece performs the reception process to acquire the current time and updates the internal time counted by the internal time counter 13.

Since the control section 20 has grasped that the indicating hands 31 to 33 are located in the reference positions, the control section 20 drives the second hand motor 51 and the hour/minute hand motor 52 to move the second hand 31, the minute hand 32, and the hour hand 33 to the positions indicating the acquired internal time.

Since the control section 20 grasps the current display position of the date indicator 35 from the display position storage 25, the control section 20 drives the date indicator motor 53 to move the date indicator 35 to the date position indicating the acquired internal time. For example, when no reception is performed immediately after the system reset and the date is therefore not changed, the date indicator 35 displays the current date, and the control section 20 therefore does not activate the date indicator motor 53. On the other hand, when the reception is performed on the date following the date on which the system reset occurs, the date has been changed, and the control section 20 therefore activates and moves the date indicator motor 53 by an amount corresponding to one day to cause the date indicator 35 to show the following date. In this process, since the control section 20 can check the polarity of the last drive pulse from the display position storage 25, the control section 20 can appropriately set the polarity of the drive pulses with which the date indicator motor 53 is driven. The date indicator motor 53 can therefore be reliably driven from the first drive pulse, preventing the date indicator 35 from moving incorrectly due to input of a first incorrect polarity drive pulse.

According to the present embodiment described above, the following advantageous effects can be provided.

(1) The control section 20 stores the current position information in the display position storage 25 whenever the date indicator 35 is driven. Therefore, when the battery voltage decreases and system reset occurs, it is unnecessary to return the date indicator 35 to the reference position. The duration of the radio correction timepiece 1 can therefore be prolonged as compared with a case where the date indicator 35 is moved to the reference position. (2) In a case where the battery voltage is increased after the system reset, and the receiver 10 acquires time information, since the current display position of the date indicator 35 is stored in the display position storage 25, which is a nonvolatile memory, the control section 20 does not need to move the date indicator 35 to the reference position but can directly move the date indicator 35 from the current display position to a position indicating the acquired time information. The average period spent to correct the display position of the date indicator 35 can therefore be shortened.

(3) Since the control section 20 further stores the polarity of the drive pulses in the display position storage 25 whenever the date indicator 35 is driven, a correct-polarity first drive pulse can be outputted to the date indicator motor 53 even after system reset occurs. The date indicator motor 53 can therefore be reliably driven by the number of outputted pulses.

Since the control section 20 stores the information described above in the display position storage 25 only when the display on the date indicator 35 is switched to another but does not store the display positions of the second hand 31, the minute hand 32, and the hour hand 33, which are frequently activated, in the display position storage 25, the frequency of the writing performed on the display position storage 25 can be as few as once per day, whereby electric power consumed by the writing operation can be lowered.

Second Embodiment

A second embodiment of the invention will next be described.

Figure 3:
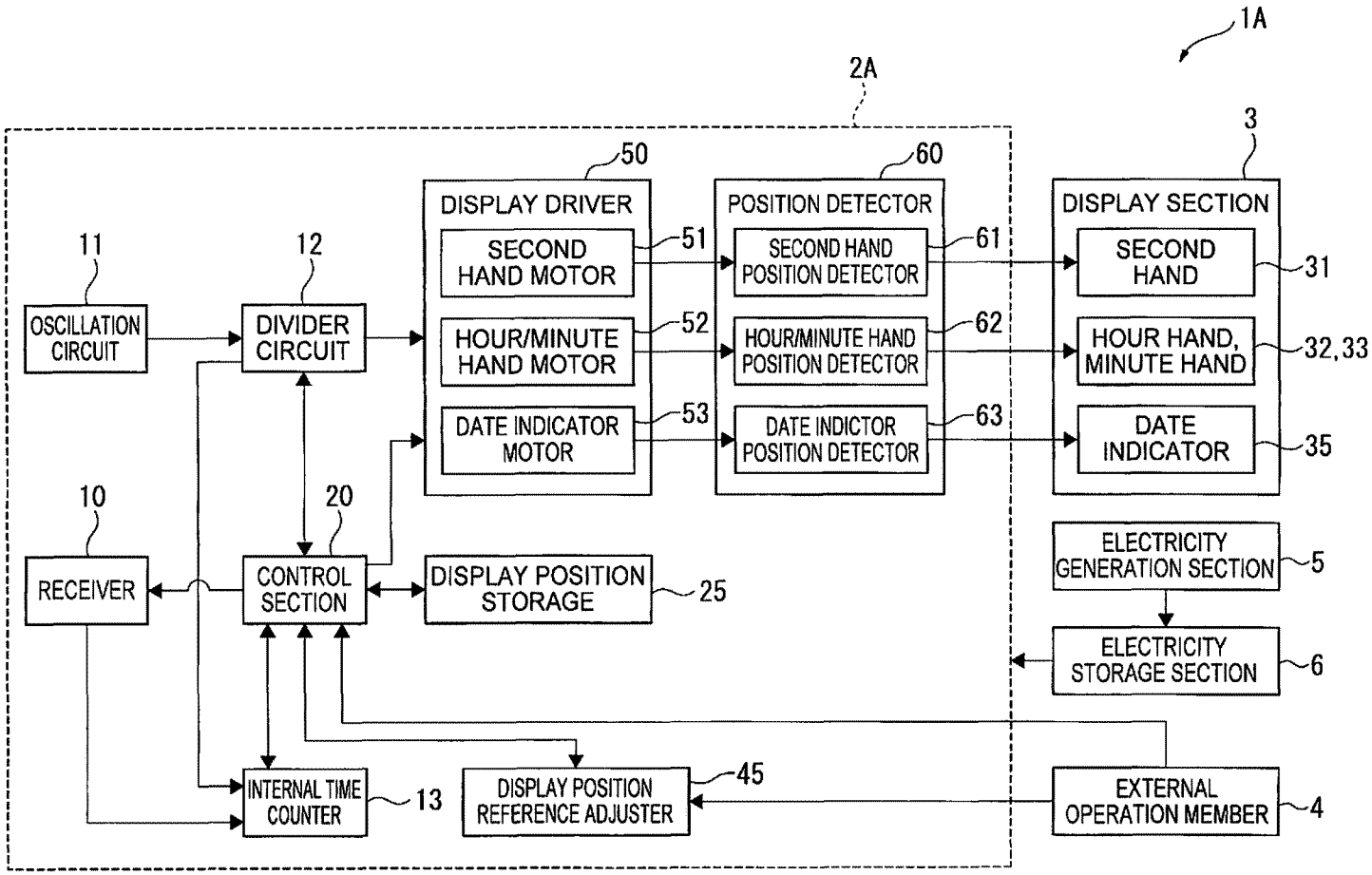
FIG. 3 is a block diagram showing the internal configuration of an electronic timepiece according to a second embodiment.

A radio correction timepiece 1A according to the second embodiment differs from the radio correction timepiece 1 described above in that a date indicator position detector 63, which detects that the date indicator 35 driven with the date indicator motor 53 has moved to the reference position (position where the date displayed through the date window 34 is the 1-st of the month), is added to the position detector 60 provided in a movement 2A, as shown in FIG. 3. The other configurations are the same as those of the radio correction timepiece 1 described above and will not therefore be described. The date indicator position detector 63 has the same configuration as those of the second hand position detector 61 and the hour/minute hand position detector 62 and will not therefore be described.

Reference position detection in which the reference position of the date indicator 35 is detected and the process in the date display position reference adjustment mode in the radio correction timepiece 1A will next be described with also reference to Table 1. It is noted that the date indicator motor 53, which moves the date indicator 35, which is typically larger than other timepiece parts, requires a plurality of drive pulses (150 pulses, for example) for day advance corresponding to one day also in the present embodiment.

In the radio correction timepiece 1A, in which when the date indicator 35 is located in a position indicating the 1-st of the month, the date indicator position detector 63 performs position detection, the reference position detection in which the reference position of the date indicator 35 is detected and the process in the date display position reference adjustment mode are carried out as follows. Further, the display position storage 25 stores the reference position information, the position information, and the drive pulse polarity information on the date indicator 35, as shown in Table 1. The display position in Table 1 represents the date displayed through the date window 34.

TABLE 1

| | | Reference position information | Position information | Polarity information | Display position |
|---|---|---|---|---|---|
| A | Reference position detection | 0 | 0 | 1 | Roughly the 1-st |
| B | Display position adjustment | +7 | 0 | 0 | The 1-st |
| C | Time reception | +7 | 10 | 0 | The 11-th |
| D | Calendar advance | +7 | 11 | 0 | The 12-th |
| E | The 1-st in following month | +7 | 0 | 0 | The 1-st |
| F | Stop operation | +7 | 15 | 0 | The 16-th |
| G | After reception | +7 | 18 | 0 | The 19-th |

A: Reference Position Detection

In the radio correction timepiece 1A, after the action mode transitions to the date display position reference adjustment mode, when the user keeps pressing a predetermined button, for example, the A button 42, the control section 20 outputs the drive pulses to the date indicator motor 53 so as to advance the date indicator 35 at high speed. The date indicator position detector 63 detects the reference position of the date indicator, specifically, detects that a state in which the "1-st" of the month is displayed through the date window 34 is achieved. The control section 20 then stops driving the date indicator motor 53 and writes "0" as the reference position information and "0" as the position information in the display position storage 25.

Further, since the date indicator motor 53 is a dipole stepping motor, the control section 20 writes information on the polarity of the drive pulse outputted immediately before the reference position is detected, that is, when the date indicator 35 has moved to the reference position in the display position storage 25. The polarity information is expressed by "0" or "1", and Table 1 shows a case where the polarity of the last drive pulse is "1".

B: Display Position Adjustment

Figure 4:
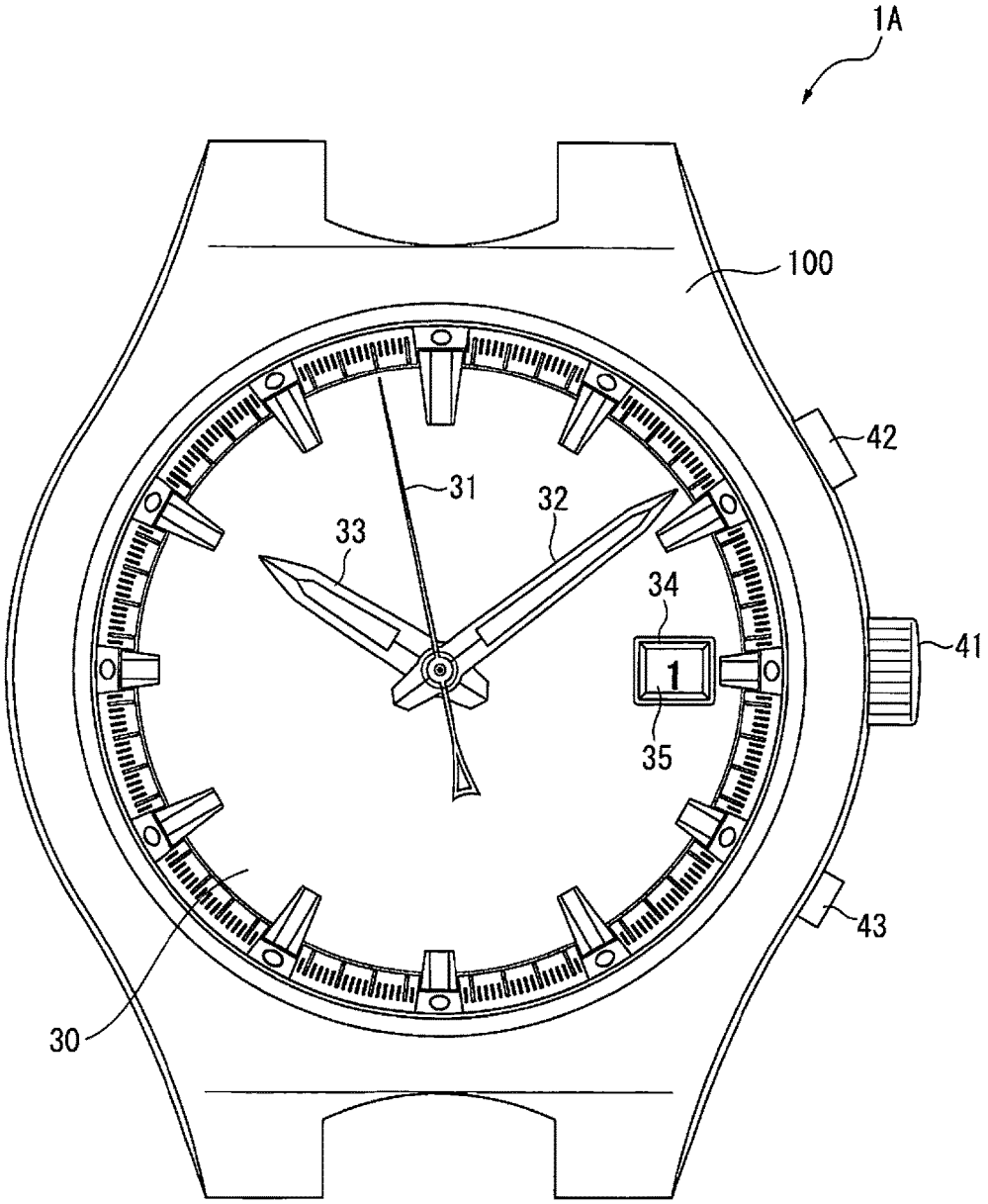
FIG. 4 is a front view showing the electronic timepiece according to the second embodiment.

When the date indicator 35 moves to the reference position, "1-st" is displayed through the date window 34. In this process, since 150 drive pulses advance one date displayed on the date indicator 35, one drive pulse corresponds to about 0.08° rotation. Variation in the position of the 1-st printed on the date indicator 35 and variation in the position of the date window 34 shift the display position of the 1-st as shown in FIG. 4 in some cases, and the reference position detected by the date indicator position detector 63 is therefore not necessarily an optimum display position.

The external operation member 4, specifically the A button 42 and the B button 43 are therefore used to make fine adjustment in such a way that "1" on the date indicator 35 is located at the center of the date window 34. When the display position adjustment is completed, the control section 20 writes the number of drive pulses having been required to move the date indicator 35 from the reference position detected by the date indicator position detector 63 to the adjusted display position as reference position information in the display position storage 25.

Table 1 shows a case where the date indicator 35 is moved by an amount corresponding to +7 pulses to move "1" to the center of the date window 34, as shown in FIG. 1. As a result, information on the difference between the "reference position detected by the date indicator position detector 63" and the "optimum display position" (+7 in Table 1) can thus be stored in the display position storage 25 in the timepiece. It is noted that the + sign of the reference position information represents the direction in which the date indicator 35 rotates. For example, the ± sign is so set that when the date indicator 35 is moved counterclockwise, a "+" numeral is stored, whereas when the date indicator 35 is moved clockwise, a "−" numeral is stored. Further, the control section 20 writes information on the polarity of the last drive pulse used to move the date indicator 35 to an optimum display position in the display position storage 25. In Table 1, since the number of drive pulses is an odd number (7), the information on the polarity of the last drive pulse is "0", and the information of "0" is written.

The reference position information in the display position storage 25 is overwritten whenever the display position adjustment of the date indicator 35 is performed.

C: Time Reception

At the point of time when the reference position adjustment of the date indicator 35 described above has been made, the "1-st" is displayed through the date window 34. Thereafter, when the standard radio wave reception is performed and time information is obtained, and when the time information shows that the date is the 11-th of the month, the control section 20 outputs drive pulses the number of which corresponds to 10 days (10 days×150) to the date indicator motor 53 to move the display position of the date indicator 35 to the position indicating the 11-th. In this process, the control section 20 writes "10" as the position information in the display position storage 25, as shown in Table 1. That is, since the position information has been set to be "0" for the "1-st", which is the reference position, the position information is "10" for the "11-th."

The control section 20 also writes the information on the polarity of the last drive pulse in the display position storage 25. Since the number of drive pulses is an even number, the information on the polarity of the last drive pulse is "0".

D: Calendar Advance

After the standard radio wave reception, and time lapses and the internal time counted by the internal time counter 13 reaches 0 o'clock AM on the following day, the control section 20 outputs 150 drive pulses, which are required to advance the date indicator 35 by the amount corresponding to one day, to the date indicator motor 53 to switch the displayed date to the "12-th." In this process, the control section 20 writes "11" as the position information and "0" as the polarity information in the display position storage 25, as shown in Table 1.

Thereafter, the control section 20 writes the position information and the polarity information in the display position storage 25 whenever the date indicator 35 is advanced by the amount corresponding to one day.

E: The 1-st in the Following Month

The radio correction timepiece 1A, when the internal time reaches 0 o'clock AM on the 1-st in the following month, advances the display on the date indicator 35 from the 31-th to the 1-st. In this process, since the display position is changed from the reference position detected by the date indicator position detector 63 by the amount corresponding to the reference position information of "+7", the control section 20 causes the date indicator position detector 63 to perform the position detection after the control section 20 outputs 150−7=143 drive pulses to the date indicator motor 53. When the date indicator position detector 63 successfully performs the detection of the position of the date indicator 35, the control section 20 outputs the remaining 7 drive pulses to the date indicator motor 53 for the display position adjustment and writes "0" as the position information and "0" as the polarity information in the display position storage 25. The display on the date indicator 35 thus becomes the "1-st."

On the other hand, when the detection performed by the date indicator position detector 63 is unsuccessful, the control section 20 performs the position detection while outputting the drive pulses to move the date indicator 35. After the reference position is found, the control section 20 outputs 7 drive pulses and writes "0" as the position information and the information on the polarity of the last drive pulse as the polarity information in the display position storage 25.

F: Stop Operation

Thereafter, in the state in which the date indicator 35 of the radio correction timepiece 1A displays the 16-th, assume that the voltage of the electricity storage section 6 decreases to a system-failure level, and the control section 20 stops driving the display driver 50. In this case, the display position storage 25, which is formed of a nonvolatile memory, keeps storing position information of "15" corresponding to the display position of "the 16-th."

G: After Reception

Thereafter, assume that the electricity generation section 5 charges the electricity storage section 6, and the radio correction timepiece 1A resumes its operation and receives the standard radio wave to acquire "the 19-th" as the time information. In this case, to change the position information from "15" corresponding to "the 16-th" to "18" corresponding to "the 19-th," 3 days×150 drive pulses need to be inputted to the date indicator motor 53. To this end, the control section 20 sets the polarity of the first drive pulse to be outputted to the date indicator motor 53 at "1" on the basis of data stored in the display position storage 25 and outputs 3 days×150 drive pulses to the date indicator motor 53. As a result, the display on the date indicator 35 can be changed to "the 19-th" without newly performing the reference position adjustment or fine adjustment of the date indicator 35.

According to the second embodiment described above, the same advantageous effects provided by the first embodiment described above can be provided. Further, since the display position storage 25 stores the reference position information, which is the information on the difference between the reference position detected by the date indicator position detector 63 and the position after the display position adjustment, the user does not need to newly make the reference position adjustment or fine adjustment of the date indicator 35 even when the voltage of the electricity storage section 6 decreases and system failure occurs, whereby the radio correction timepiece 1A can be a timepiece readily handled by the user.

The invention is not limited to the embodiments described above, and changes, improvements, and other modifications made to the embodiments described above to the extent that the advantage of some aspects of the invention can be achieved fall within the scope of the invention.

For example, each of the radio correction timepieces 1 and 1A according to the embodiments of the invention may instead be a timepiece including a day indicator or any other calendar wheel in place of the date indicator 35 or a timepiece including a day indicator or any other calendar wheel in addition to the date indicator 35. When a plurality of calendar wheels are provided, the position information may be stored in the display position storage 25 whenever each of the calendar wheels is activated.

In the embodiments described above, the polarity information on the drive pulses and the reference position information are stored in the display position storage 25, but at least the position information representing the display position of a calendar wheel only needs to be stored in the display position storage 25. However, storing the polarity information on the drive pulses is advantageous in that the motor can be reliably driven from the first drive pulse after system failure occurs. Further, storing the reference position information is advantageous in that when the user or any other person makes fine adjustment of a calendar wheel, a result of the adjustment can be stored and further fine adjustment is therefore unnecessary.

The nonvolatile memory that forms the display position storage 25 is not limited to an EEPROM and may be any memory that does not allow stored data to be erased even when the voltage of the electricity storage section 6 decreases, such as a flash memory.

The position information stored in the display position storage 25 is not limited to information on a calendar wheel, such as the date indicator 35 and a day indicator, and may instead be information on the "hour," "minute," and "second."

Further, each of the radio correction timepieces 1 and 1*a* is not limited to a timepiece that receives a standard radio wave to acquire time information, and the invention is widely applicable to any timepiece that acquires time information from an apparatus external to the timepiece, such as a timepiece that receives a radio wave from a GPS (global positioning system) satellite to acquire time information.

Further, in the invention, the analog display member is not limited to a member that indicates time information and may be a member that displays information other than time information. For example, the analog display member may be an indicating hand that displays the charged level of the electricity storage section 6 or a mode hand that displays the action mode (such as reception mode) of an electronic timepiece. It is also necessary for any of these analog display members to specify a reference position thereof, and the invention is applicable in this case. The electronic timepiece according to any of the embodiments of the invention is therefore not limited to a radio correction timepiece that receives a radio wave to correct time information and may be a typical analog electronic timepiece.

The entire disclosure of Japanese Patent Application No. 2015-089385, filed Apr. 24, 2015 is expressly incorporated by reference herein.

What is claimed is:

1. An electronic timepiece comprising:

a dial with a display part including a calendar window;

an analog display member including a calendar wheel, the analog display member being movable with respect to the dial and displayed at the display part of the dial;

a driver that drives the analog display member;

a nonvolatile memory that stores position information of the analog display member;

a time information acquirer that externally acquires time information;

a control section that outputs a drive signal to the driver and stores the position information on the analog display member in the nonvolatile memory whenever the driver activated with the drive signal drives the analog display member;

an external operation member that activates the driver via the control section to drive the analog display member for position adjustment; and a position detector that detects that the analog display member has moved to a preset reference position, wherein the control section causes the nonvolatile memory to store adjustment information on an amount of the position adjustment performed through the external operation member, the adjustment information being indicative of a position deviation between the preset reference position and the display part of the dial, and wherein the control section outputs the drive signal to the driver to drive the analog display member with respect to the dial by the amount of the position adjustment based on the adjustment information stored in the nonvolatile memory to align an indicator of the analog display member relative to the display part of the dial while the indicator of the analog display member is being displayed at the display part of the dial in response to the position detector detecting that the analog display member has moved to the preset reference position to display the indicator of the analog display member at the display part of the dial.

2. The electronic timepiece according to claim 1, wherein the analog display member, the position information of which is stored in the nonvolatile memory, is an analog display member that displays information other than a second, a minute, or an hour.

3. The electronic timepiece according to claim 1, wherein the driver is a stepping motor, and the control section stores the position information on the analog display member and polarity information on the drive signal outputted to the stepping motor in the nonvolatile memory.

4. The electronic timepiece according to claim 1, wherein the control section overwrites reference position information stored in the nonvolatile memory when the reference position adjustment of the analog display member is performed through the external operation member.

* * * * *